US007829601B2

(12) United States Patent
Ploeg et al.

(10) Patent No.: US 7,829,601 B2
(45) Date of Patent: Nov. 9, 2010

(54) PROCESS FOR OPERATING A PARTIAL OXIDATION PROCESS OF A SOLID CARBONACEOUS FEED

(75) Inventors: Johannes Everdinus Gerrit Ploeg, Bussum (NL); Jacobus Hendrikus Scheerman, Amsterdam (NL)

(73) Assignee: Shell Oil Company, Houston, TX (US)

( * ) Notice: Subject to any disclaimer, the term of this patent is extended or adjusted under 35 U.S.C. 154(b) by 291 days.

(21) Appl. No.: 12/101,678

(22) Filed: Apr. 11, 2008

(65) Prior Publication Data

US 2008/0262111 A1 Oct. 23, 2008

Related U.S. Application Data

(60) Provisional application No. 60/914,157, filed on Apr. 26, 2007.

(30) Foreign Application Priority Data

Apr. 11, 2007 (EP) ..... 07105919

(51) Int. Cl.
*C07C 27/00* (2006.01)
*C10J 1/28* (2006.01)

(52) U.S. Cl. ..... 518/703; 518/700; 48/197 R

(58) Field of Classification Search ..... 518/700, 518/703; 48/197 R
See application file for complete search history.

(56) References Cited

U.S. PATENT DOCUMENTS

| | | | | |
|---|---|---|---|---|
| 2,941,877 | A | 6/1960 | Grahame | 48/196 |
| 3,976,442 | A | 8/1976 | Paull et al. | 48/197 R |
| 4,202,672 | A | 5/1980 | Schuurman | 48/77 |
| 4,490,156 | A * | 12/1984 | Marion et al. | 48/61 |
| 4,510,874 | A | 4/1985 | Hasenack | 110/347 |
| 4,523,529 | A | 6/1985 | Poll | 110/263 |
| 4,531,949 | A | 7/1985 | Koyama et al. | 48/202 |
| 4,801,440 | A | 1/1989 | Naijar et al. | 423/415 |
| 4,851,013 | A | 7/1989 | Luke | 48/203 |
| 4,887,962 | A | 12/1989 | Hasenanck et al. | 110/263 |
| 6,596,781 | B1 * | 7/2003 | Schinski | 518/700 |
| 2006/0210457 | A1 | 9/2006 | Sprouse et al. | 422/198 |

FOREIGN PATENT DOCUMENTS

| | | |
|---|---|---|
| GB | 837074 | 6/1960 |
| WO | WO 2004005438 | 1/2004 |
| WO | WO 2007042562 | 4/2007 |

* cited by examiner

*Primary Examiner*—Jafar Parsa

(57) ABSTRACT

The invention is directed to a process for preparing a mixture comprising CO and $H_2$ by operating a partial oxidation process of a solid carbonaceous feed, which process comprises the steps of:

(a) supplying the solid carbonaceous feed and an oxygen-containing stream to a burner, wherein a $CO_2$ containing transport gas is used to transport the solid carbonaceous feed to the burner;

(b) partially oxidizing the carbonaceous feed in the burner wherein a gaseous stream comprising CO and $H_2$ is being discharged from said burner into a reaction zone, wherein the temperature in the reaction zone is from 1200 to 1800° C. and wherein said reaction zone is at least partly bounded by a wall, which wall comprises conduits in which steam is prepared by evaporation of water, resulting in a flow of steam being discharged from said reaction zone;

(c) monitoring the conditions in the reaction zone by continually or periodically measuring the rate of the steam flow and using said flow rate as input to adjust the oxygen-to-coal (O/C) ratio in step (a).

15 Claims, 1 Drawing Sheet

PROCESS FOR OPERATING A PARTIAL OXIDATION PROCESS OF A SOLID CARBONACEOUS FEED

This application claims the benefit of European application No. 07105919.0, filed Apr. 11, 2007 and U.S. provisional application No. 60/914,157, filed Apr. 26, 2007, both of which are incorporated herein by reference.

TECHNICAL FIELD OF THE INVENTION

The present invention is directed to a process for operating a partial oxidation process of a solid carbonaceous feed to prepare a mixture comprising of CO and $H_2$. Mixtures of CO and $H_2$ are also referred to as synthesis gas.

BACKGROUND OF THE INVENTION

U.S. Pat. No. 3,976,442 describes a process wherein a solid carbonaceous feed is transported in a $CO_2$ rich gas to a burner of a pressurized gasification reactor operating at about 50 bar. According to the examples of this publication a flow of coal and carbon dioxide at a weight ratio of $CO_2$ to coal of about 1.0 is supplied to the annular passage of the annular burner.

Process control is important in a process wherein solid carbonaceous feeds are partially oxidized. It has been found that the quality of the synthesis gas as obtained may vary, due to e.g. disturbances or variations in the solid carbonaceous stream and the oxygen containing stream being fed to the gasification reactor, the amount of ash in the carbonaceous stream, etc. If for example coal is used as the carbonaceous stream, variations in $H_2O$ content of the coal may result in altered process conditions in the gasification reactor, as a result of which the composition of the synthesis gas will also vary.

Various methods of controlling a partial oxidation process are known. For example GB-A-837074 describes a process wherein the carbon dioxide in the product gas of a partial oxidation process is measured to control the steam flow.

U.S. Pat. No. 2,941,877 describes a process for controlling the oxygen-to-carbon feed ratio in a partial oxidation reactor. The oxygen-to-carbon feed ratio is controlled by measuring the methane concentration in the product gas using infrared measurement technique. A disadvantage of using methane as the control input is that the signal is not a sharp signal, making control less accurate.

U.S. Pat. No. 4,851,013 describes a process wherein the partial oxidation process is performed in a pressurized gasification reactor provided with an inside wall consisting of conduits. The conduits are cooled by evaporation of water to steam inside the conduits. This results in a steam rate, which is measured and used as input to control the flow of either oxygen or solid carbonaceous feed, to said gasification reactor.

U.S. Pat. No. 4,801,440 describes a process for the simultaneous partial oxidation and desulphurization of a sulphur and silicate-containing solid carbonaceous fuel. In said process a slurry of solid feed and liquid carbon dioxide is fed to a partial oxidation reactor wherein partial oxidation and desulphurization takes place at a temperature of below 2000° F. (1093° C.). The amount of carbon dioxide is between 10 and 30 wt % basis on weight of feed.

It would be advantageous to provide a process to prepare a synthesis gas having less inert compounds, such as nitrogen, which process is effectively controlled.

SUMMARY OF THE INVENTION

In some embodiments the invention provides a process for preparing a mixture comprising CO and $H_2$ by operating a partial oxidation process of a solid carbonaceous feed, which process comprises the steps of:

(a) supplying the solid carbonaceous feed and an oxygen-containing stream to a burner, wherein a $CO_2$ containing transport gas is used to transport the solid carbonaceous feed to the burner;

(b) partially oxidising the carbonaceous feed in the burner wherein a gaseous stream comprising CO and $H_2$ is being discharged from said burner into a reaction zone, wherein the temperature in the reaction zone is from 1200 to 1800° C. and wherein said reaction zone is at least partly bounded by a wall which wall comprises conduits in which steam is prepared by evaporation of water, resulting in a flow of steam being discharged from said reaction zone;

(c) monitoring the conditions in the reaction zone by continually or periodically measuring the rate of the steam flow and using said flow rate as input to adjust the oxygen-to-coal (O/C) ratio in step (a).

BRIEF DESCRIPTION OF THE DRAWING

The invention has been illustrated by the following figure.

DETAILED DESCRIPTION OF THE INVENTION

Figure 1:
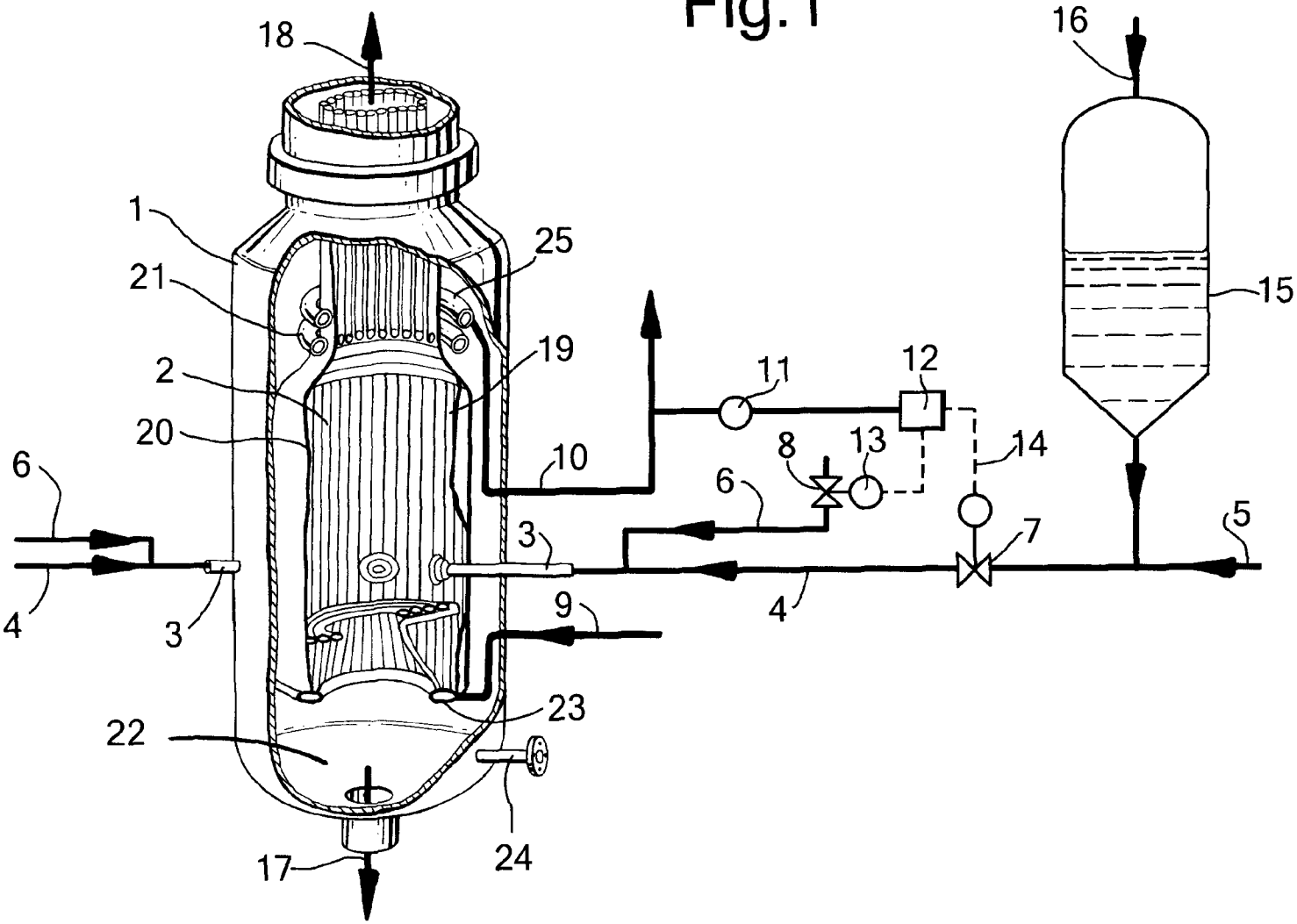
FIG. 1 schematically shows a process scheme suited for performing the process of the present invention.

The process according to the invention provides a process wherein a synthesis gas is obtained which contains much less inert compounds as for example nitrogen. Furthermore a process is obtained wherein the O/C ratio can be controlled in a simple and direct manner. Maintaining an optimal O/C ratio has been found very beneficial for achieving the most optimal yield over time of synthesis gas.

The solid carbonaceous feed may be any carbonaceous feed in solid form. Examples of solid carbonaceous feeds are coal, coke from coal, petroleum coke, soot, biomass and particulate solids derived from oil shale, tar sands and pitch. In a particular embodiment the solid carbonaceous feed is coal. The coal may be of any type, including lignite, sub-bituminous, bituminous and anthracite. In one embodiment the solid carbonaceous feed is supplied to the reactor as fine particulates. Fine particulates include, but are not limited to, pulverized particulates having a particle size distribution so that at least about 90% by weight of the material is less than 90 μm. Moisture content may be between 2 and 12% by weight, or less than about 5% by weight.

The $CO_2$ containing stream supplied in step (a) may be any suitable $CO_2$ containing stream. The stream may contain at least 80%, or at least 95% $CO_2$. Furthermore, the $CO_2$ containing stream is may be obtained by separating the $CO_2$ from the synthesis gas as prepared and recycling said gas to step (a).

The $CO_2$ containing stream supplied in step (a) may be supplied at a velocity of less than 20 m/s, from 5 to 15 m/s, or from 7 to 12 m/s. Further the $CO_2$ and the carbonaceous feed may be supplied as a single stream, at a density of from 300 to 600 kg/m$^3$, from 350 to 500 kg/m$^3$, or from 375 to 475 kg/m$^3$.

In a specific embodiment of the process according to the present invention, the weight ratio of $CO_2$ to the carbonaceous feed in step (a) is less than 0.5 on a dry basis. In a further embodiment this ratio is in the range from 0.12 to 0.49, below 0.40, below 0.30, below 0.20 or from 0.12 to 0.20 on a dry basis. It has been found that by using the relatively low weight ratio of $CO_2$ to the carbonaceous feed in step (a) less oxygen is consumed during the process. Further, less $CO_2$ has to be removed from the system afterwards than if a more dilute $CO_2$ phase would have been used.

In step (b) the carbonaceous feed is partially oxidized in the burner. A gaseous stream comprising CO and $H_2$ is discharged from said burner into a reaction zone. The reaction zone is at least partly bounded by one or more wall(s) which wall(s) is/are comprised of conduits. In such conduits steam is prepared by evaporation of water. An example of such a wall is a so-called membrane wall wherein the parallel positioned conduits are interconnected such as to form a gas tight wall as described in Gasification, Chris Higman and Maarten van der Burgt, Elsevier Science, Burlington Mass., USA, 2003, pages 187-188. A suited and well-known example of a gasification reactor provided with a membrane wall is the Shell Coal Gasification Process as described in the afore mentioned textbook 'Gasification' on pages 118-120. Other publications describing such gasification reactors are for example U.S. Pat. No. 4,202,672 and WO-A-2004005438. Said publications describe so-called side-fired reactors. The invention is however also suited for top fired reactors having a reaction zone provided with walls comprised of conduits in which steam is prepared by evaporating water. In such so-called top fired reactors the synthesis gas and slag both flow in a downwardly direction relative to the burner.

The pressure in the reaction zone may be higher than 10 bar, between 10 and 90 bar, lower than 70 bar, or lower than 60 bar. The temperature in the reaction zone is between 1200 to 1800° C. The burner and other process conditions for performing a partial oxidation in such burner are for example described in U.S. Pat. No. 4,887,962, U.S. Pat. No. 4,523,529 or U.S. Pat. No. 4,510,874.

In some embodiments the synthesis gas obtained in step (b) comprises from 1 to 10 mol % $CO_2$, or from 4.5 to 7.5 mol % $CO_2$ on a dry basis when performing the process according to the present invention.

In step (c) the conditions in the reaction zone are monitored by continually or periodically measuring the steam flow rate and using said flow rate as input to adjust the O/C ratio in step (a). A method in which the steam flow rate may be used will be described below. Said method comprises a first step (i) wherein a relation between synthesis gas flow and the optimal steam production is obtained. This relation can be obtained by model calculations or by experiment in the gasification unit itself. The optimal steam production is defined as the steam flow rate at which the most selective conversion to carbon monoxide and hydrogen is achieved for a certain synthesis gas flow in step (b). In model calculations use will be made of the quality of the solid carbonaceous feed, for example the carbon content, ash content, water content, the quality of the slag layer which will form under said conditions and feed quality and the resultant heat transfer to the wall comprising of conduits.

In a subsequent step (ii) the relation is embedded in a control algorithm of a computerized control system.

In use the steam flow rate as measured in step (c) is compared with the optimal steam production valid for the actual synthesis gas production by the computerized control system. If the measured steam flow is lower than the optimal steam production the O/C ratio will be adjusted to a higher value. If the measured steam production is higher than the optimal steam production the O/C ratio will be adjusted to a lower value. With the term lower and higher steam flow rate is meant a condition wherein the absolute difference between the optimal steam flow and the measured steam flow exceeds a certain pre-determined difference value.

Modest deviations between the optimal steam rate and the measured steam rate will be used to control the O/C ratio as in the present process. A modest deviation may be understood to be a deviation of below 25%, wherein this percentage is calculated as 100% times ABS((optimal steam rate) minus (measured steam rate))/(optimal steam rate). Above this range other control measures can be triggered. For example a wide deviation from the optimal steam rate may indicate an upset stage, calling, for example, for shutdown procedures.

The O/C ratio can be adjusted by adjusting the rate of the oxygen-containing stream, the rate of the solid carbonaceous stream or both. Preferably the O/C ratio is adjusted by adjusting the flow rate of the solid carbonaceous stream, whilst keeping the oxygen-containing stream constant.

In the present invention "O" in the O/C ratio may be understood as the weight flow of molecular oxygen, $O_2$, as present in the oxygen containing stream; and "C" in the O/C ratio may be understood as the weight flow of the carbonaceous feed excluding the $CO_2$ as present as carrier gas.

The person skilled in the art will readily understand how to select the initial O/C ratio for a specific solid carbonaceous stream to as used in step (a). The starting O/C ratio may e.g. be determined using known energy content data for a specific carbonaceous stream such as the heating value of the feedstock in J/kg. Usually, having determined the desired selected O/C ratio, the $O_2$ content in the oxygen-containing stream will be determined and the suitable flow rates for the carbonaceous and oxygen containing feed streams will be established to obtain the desired O/C ratio.

The person skilled in the art will readily understand that the streams supplied in step (a) may have been pre-treated, if desired, before being supplied to the gasification reactor. However it is more difficult to pre-treat a solid feed than to for example purify the synthesis gas as obtained in step (b). Therefore it may be preferred to further process the synthesis gas as obtained in step (b). As an example, the synthesis gas may be subjected to dry solids removal, wet scrubbing, removal of sulphur compounds, like for example $H_2S$ and COS, a water gas shift reaction, removal of metal carbonyls and removal of HCN.

In some embodiments the synthesis gas is subjected to a hydrocarbon synthesis reactor thereby obtaining a hydrocarbon product, in particular methanol or dimethyl ether. The hydrocarbon synthesis may also be a Fischer-Tropsch synthesis. An example of a possible line-up wherein the synthesis gas is treated and subsequently used as feed for a Fischer-Tropsch synthesis is described in WO-A-2006/070018. The line-up as described in said publication may also be used to prepare a feed for the aforementioned methanol and dimethyl ether synthesis processes. The methanol or dimethyl ether products may serve as feed for further processes to prepare lower olefins, i.e. ethylene, propylene and butylene and gasoline type products.

The invention is therefore further directed to a process wherein additional step (d) is performed:

(d) shift converting the gaseous stream as obtained in step (b) by at least partially converting CO into $CO_2$, thereby obtaining a CO depleted stream.

In some embodiments the process further comprises the step of:

(e) subjecting the CO depleted stream as obtained in step (d) to a $CO_2$ recovery system thereby obtaining a $CO_2$ rich stream and a $CO_2$ poor stream.

In further embodiments the $CO_2$ poor stream as obtained in step (e) is subjected to a methanol synthesis reaction, thereby obtaining methanol; to a dimethyl ether synthesis reaction to obtain dimethyl ether; or to a Fischer-Tropsch reaction to obtain various hydrocabons.

According to an a special embodiment the $CO_2$ rich stream as obtained in step (e) is at least partially used as the $CO_2$ containing stream as supplied in step (a). Any type of $CO_2$-recovery may be employed, but absorption based $CO_2$-recovery, such as physical or chemical washes, may be advantageous because such recovery also removes sulphur-containing components such as $H_2S$ from the process path. An example of a suited process is the Rectisol® Process from Lurgi AG.

In a start-up phase of the presently claimed process it may be desirable to use nitrogen as the transport gas. This because carbon dioxide may not be readily available at start-up conditions and will be available, as a by-product of the present process, after the process has started up. When the amount of carbon dioxide is recovered from the gaseous stream prepared in step (b) or from the effluent of a possible downstream water gas shift reaction is sufficient, the amount of nitrogen can be reduced to zero. Nitrogen may be prepared in a so-called air separation unit which unit also prepares the oxygen-containing stream used in step (a). The invention is thus also related to a method to start the process according to a specific embodiment of the invention wherein the carbon dioxide as obtained in step (e) is used in step (a). In this method nitrogen is used as transport gas in step (a) until the amount of carbon dioxide as obtained in step (e) is sufficient to replace the nitrogen.

FIG. 1 shows a process scheme suited for performing the process of the present invention. In this scheme the lower and worked open part of a gasification reactor (1) is shown. Such a reactor may be suitably a reactor as disclosed in WO-A-2004/005438. FIG. 1 shows a pressurized storage vessel (15) containing the solid carbonaceous feed provided with a supply conduit (16) to supply fresh feed.

The mixture comprising of CO and $H_2$ is referred to as stream (18). Also shown are supply means (4) to supply the solid carbonaceous feed and supply means (6) to supply an oxygen-containing stream to one or more of burners (3). Typically, the pressure inside the storage vessel (15) exceeds the pressure inside the reaction zone (2), in order to facilitate injection of the powder coal into the reactor.

The reactor (1) has two pairs of diametrical opposed burners (3) of which 3 burners are shown in FIG. 1. More of such pairs may be present. A $CO_2$ containing transport gas is supplied via stream (5) and mixed with the carbonaceous feed. The mixture of transport gas and solid carbonaceous feed is transported via (4) to the burner (3). In the burner (3) the solid carbonaceous feed is partially oxidised resulting in that a gaseous stream at least comprising CO and $H_2$ is being discharged from said burner (3) into a reaction zone (2).

The reaction zone (2) is at least partly bounded by a wall (20) comprised of vertical positioned conduits (19) in which conduits steam is prepared by evaporation of water resulting in a flow of steam being discharged from said reaction zone (2) via conduit (10). Fresh water is fed to the wall (20) via supply conduit (9). Also shown is a common distributor (23) for water as supplied via (9) and a common header (25) for steam.

The steam flow rate in conduit (10) is monitored via measuring device (11), which provides a signal to computerized control unit (12). In said control unit (12) the steam rate is compared to the optimal steam production valid for the actual synthesis gas production (18). When the measured steam flow as measured by device (11) is lower than the optimal steam production the O/C ratio will be adjusted to a higher value by adjusting the valves (8) and (7) via control lines (13) and (14) respectively. Preferably only valve (7) is controlled by unit (12). When the measured steam flow as measured by device (11) is higher than the optimal steam production the O/C ratio will be similarly adjusted to a lower value.

FIG. 1 also shows a water slag bath (22) for collecting slag, which will flow downwards along the wall (20). The slag bath (22) is provided with water supply means (24). Slag and water will be discharged via stream (17). Further a ring (21) is shown through which quench gas is added to cool the upwardly moving hot synthesis gas (18).

EXAMPLE 1

The following Table I compares the use of carbon dioxide and nitrogen as transport gasses. The synthesis gas capacity (CO and $H_2$) was 72600 $NM^3$/hr, but any other capacity will do as well. The middle column gives the composition of the synthesis gas after being subjected to a wet scrubber using carbon dioxide as transport gas. The right hand column gives a reference where $N_2$ was used as transport gas.

TABLE I

| composition (in wt. %) | | |
|---|---|---|
| | $CO_2$ based (inv.) | $N_2$ based (reference) |
| $CO + H_2$ | 89.3 | 87.8 |
| CO | 69.6 | 64.1 |
| $H_2$ | 19.7 | 23.7 |
| $N_2$ | 0.44 | 4.84 |
| $CO_2$ | 9.29 | 6.42 |
| $H_2S$ | 0.44 | 0.67 |
| $H_2O$ | 18.8 | 18.8 |

As can be seen, the nitrogen content in the synthesis gas is decreased by more than a factor of ten utilizing the invention relative to the reference. The $CO_2$ content has increased a little relative to the reference, but this is considered to be of minor importance relative to the advantage of lowering the nitrogen content.

EXAMPLE 2

The following Table II illustrates the influence of the weight ratio of $CO_2$ to the solid coal feed. As can be seen from Table II, the oxygen consumption per kg coal in example T1, T2 and T3 are significantly lower than the oxygen consumption in T4.

TABLE II

| influence of weight ratio of $CO_2$ to the carbonaceous feed | | | | |
|---|---|---|---|---|
| | T1 | T2 | T3 | T4 |
| Weight ratio of $CO_2$ to coal | 0.14 | 0.19 | 0.29 | 1.0 |
| $CO + H_2$ [mol %] | 95.8 | 89.9 | 87.6 | 83.76 |
| CO [mol %] | 77.3 | 72.0 | 72.2 | 67.46 |
| $H_2$ [mol %] | 18.5 | 17.9 | 15.4 | 16.30 |
| $N_2$ [mol %] | 0.5 | 0.4 | 0.4 | 0.58 |
| $CO_2$ [mol %] | 1.8 | 4.8 | 6.4 | 13.03 |
| $H_2S$ [mol %] | 0.1 | 0.1 | 0.1 | 1.65 |
| $H_2O$ [mol %] | 1.7 | 4.6 | 5.3 | Not indicated |

TABLE II-continued

| influence of weight ratio of $CO_2$ to the carbonaceous feed | | | | |
|---|---|---|---|---|
| | T1 | T2 | T3 | T4 |
| $O_2$/Coal [kg/kg] | 0.734 | 0.748 | 0.758 | 0.901 |

The invention claimed is:

1. A process for preparing a mixture comprising CO and $H_2$ by operating a partial oxidation process of a solid carbonaceous feed, which process comprises the steps of:

(a) supplying the solid carbonaceous feed and an oxygen-containing stream to a burner, wherein a $CO_2$ containing transport gas is used to transport the solid carbonaceous feed to the burner;

(b) partially oxidising the carbonaceous feed in the burner wherein a gaseous stream comprising CO and $H_2$ is being discharged from said burner into a reaction zone, wherein the temperature in the reaction zone is from 1200 to 1800° C. and wherein said reaction zone is at least partly bounded by a wall , which wall comprises conduits in which steam is prepared by evaporation of water, resulting in a flow of steam being discharged from said reaction zone;

(c) monitoring the conditions in the reaction zone by continually or periodically measuring the rate of the steam flow and using said flow rate as input to adjust the oxygen-to-coal (O/C) ratio in step (a).

2. A process according to claim 1, wherein the weight ratio of $CO_2$ to the carbonaceous feed in step (a) is less than 0.5 on a dry basis.

3. A process according to claim 2, wherein the weight ratio of $CO_2$ to the carbonaceous feed in step (a) is in the range from 0.12-0.49.

4. A process according to claim 3, wherein the weight ratio of $CO_2$ to the carbonaceous feed in step (a) is in the range from 0.12-0.2.

5. A process according to claim 1, wherein the gaseous stream obtained in step (b) comprises from 1 to 10 mol % $CO_2$.

6. A process according to claim 1, wherein the $CO_2$ containing stream supplied in step (a) is supplied at a velocity of less than 20 m/s.

7. A process according to claim 1, wherein the solid carbonaceous feed is coal.

8. A process according to claim 1, wherein step (c) is performed by a computerized system, which system compares the steam flow rate as measured with an optimal steam production valid for the actual synthesis gas production such that when the measured steam flow is lower than the optimal steam production the oxygen-to-coal ratio will be adjusted to a higher value or when the measured steam production is lower than the optimal steam production the oxygen-to-coal ratio will be adjusted to a lower value and wherein the optimal steam production is the steam production which relates to the optimal production of CO and $H_2$ in step (b).

9. A process according to claim 8, wherein the oxygen-to-coal ratio is adjusted by adjusting the flow rate of the solid carbonaceous stream, whilst keeping the oxygen-containing stream constant.

10. A process according to claim 1, wherein a step (d) is performed in which step the gaseous stream as obtained in step (b) is subjected to a water gas shift conversion wherein CO is at least partially converted into $CO_2$ in the presence of steam, thereby obtaining a CO depleted stream.

11. A process according to claim 10, wherein the process further comprises a step (e) wherein the CO depleted stream as obtained in step (d) is subjected to a $CO_2$ recovery system, thereby obtaining a $CO_2$ rich stream and a $CO_2$ poor stream.

12. A process according to claim 11, wherein the $CO_2$ poor stream as obtained in step (e) is further purified and subjected to a methanol synthesis reaction to obtain methanol; to a dimethyl ether synthesis reaction to obtain dimethyl ether; or to a Fischer-Tropsch reaction to obtain various hydrocabons.

13. A process to prepare methanol by performing a methanol synthesis reaction using a gaseous stream comprising CO and H2 as obtained by the process claimed in claim 1.

14. A process to prepare dimethyl ether by performing a synthesis reaction to obtain dimethyl ether using the gaseous stream at least comprising CO and $H_2$ as obtained by the process claimed in claim 1.

15. A process to prepare a hydrocarbon by performing a Fischer-Tropsch reaction using the gaseous stream at least comprising CO and $H_2$ as obtained by the process claimed in claim 1.

* * * * *